United States Patent [19]

Dixon et al.

[11] 4,266,664

[45] May 12, 1981

[54] PACKAGING FOR SAFETY RAZORS

[76] Inventors: Roy P. Dixon, 96 Clarence Ave., New Malden, Surrey, England; John F. Kelly, 6 Thurnby Ct., Wellesley Rd., Twickenham, Middlesex, England

[21] Appl. No.: 104,678

[22] Filed: Dec. 17, 1979

[30] Foreign Application Priority Data

Dec. 19, 1978 [GB] United Kingdom ..... 49148/78

[51] Int. Cl.[3] ..... A45D 27/29

[52] U.S. Cl. ..... 206/349; 206/45.14; 206/485

[58] Field of Search ..... 206/45.14, 349, 434, 206/485

[56] References Cited

U.S. PATENT DOCUMENTS

| | | | |
|---|---|---|---|
| 942,483 | 12/1909 | Clark . | |
| 2,229,427 | 1/1941 | Tanner | 206/45.14 |
| 2,911,096 | 11/1959 | Andre | 206/434 |
| 3,735,860 | 5/1973 | Nissen | 206/349 |
| 4,062,450 | 12/1977 | Carter | 206/485 |
| 4,140,244 | 2/1979 | Clabby . | |
| 4,201,294 | 5/1980 | Roccaforte | 206/45.14 |

*Primary Examiner*—Herbert F. Ross

*Attorney, Agent, or Firm*—Richard A. Wise; Mandel E. Slater

[57] ABSTRACT

A package for a number of safety razors each having an elongate handle and a transversely extending shaving head at the upper end thereof is described. The package is formed from card which is cut, shaped and secured to form an envelope enclosing at least the major portion of the lengths of the razor handles; the opposite sides of the envelope each include an elongate slot, the two slots being in registry with each other to permit the shaving heads of the razors to project from each side of the envelope. A pair of flaps integral with the remainder of the package overlies the projecting heads to each side of the envelope.

6 Claims, 8 Drawing Figures

PACKAGING FOR SAFETY RAZORS

BACKGROUND OF THE INVENTION

This invention relates to packaging for the storage and merchandising of safety razors of the form comprising an elongate handle having a transversely extending shaving head at the upper end thereof.

When marketing razors of this form, it is usual to include a number of razors in a single package, which may simply be a polythene bag, with or without a backing card in the bag with the razors.

The present invention aims at the provision of an improved form of packaging affording a higher degree of protection for the razors, but which is readily and cheaply produced and loaded.

SUMMARY OF THE INVENTION

In accordance with the invention, there is provided a package for a plurality of razors each having an elongate handle and a transversely extending shaving head at the upper end thereof, the package being formed from card which is cut, shaped and secured to form an envelope enclosing at least the major portion of the lengths of the razor handles, the opposite sides of the envelope each being formed with an elongate slot, the two said slots being in registry with each other to permit the shaving heads of the razors to project from each side of the envelope, and a pair of flaps integral with the remainder of the package overlying the projecting heads to each side of the envelope.

BRIEF DESCRIPTION OF THE DRAWING

Some forms of packaging in accordance with the invention will now be described by way of example with reference to the accompanying drawing, in which.

DESCRIPTION OF PREFERRED EMBODIMENTS

Figure 1:
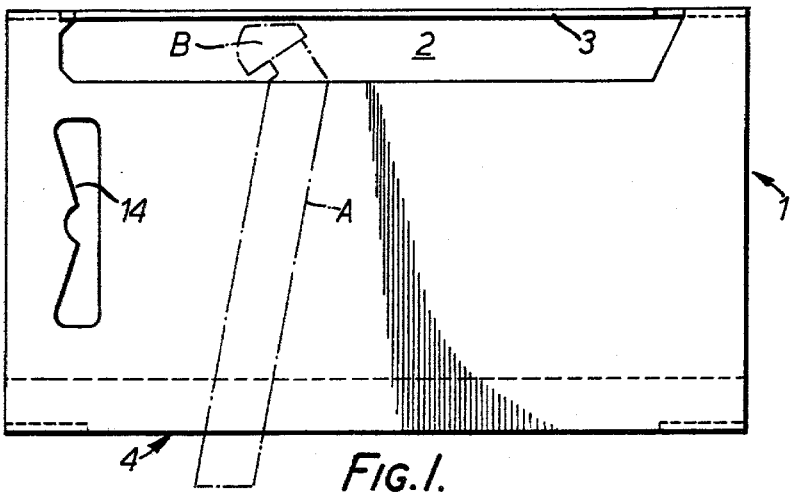
FIG. 1 is a side view of one form of package.
Figure 2:
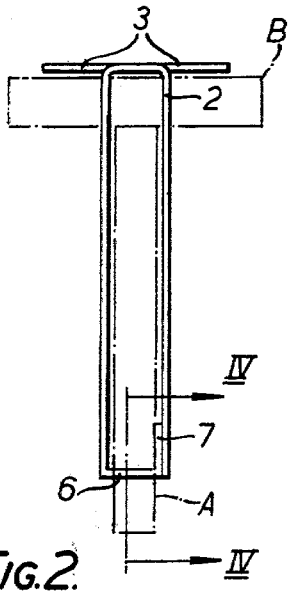
FIG. 2 is an end view of the package of FIG. 1.

The illustrated packages are for the display and merchandising of disposable safety razors, each of generally conventional form comprising an elongate handle A with a transversely extending shaving head B fast with the upper end thereof, as shown in phantom line in FIGS. 1 and 2. Each package is designed to accommodate a number of such razors, say about three to ten.

In each embodiment the package is formed from a single piece of card, cut, shaped and secured to define an envelope section 1 enclosing the major portion of the lengths of the razor handles A, the two side walls of the envelope having elongate slots 2 cut out adjacent the top edge of the envelope through which the heads B project to either side, and a pair of flaps 3 projecting laterally to overlie the heads B. At the lower edge of the envelope the handles A project downwardly through an elongate opening 4, whose opposite ends are positioned near the side edges of the envelope. The flaps 3 are conveniently complementary in shape to the slots 2, each being secured to the remainder of the package along one edge which bounds the adjacent slot.

Figure 4:
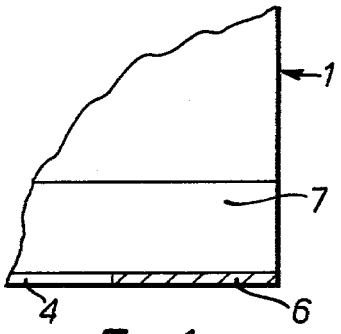
FIG. 4 is an enlarged scrap section with line IV—IV of FIG. 2.
Figure 3:
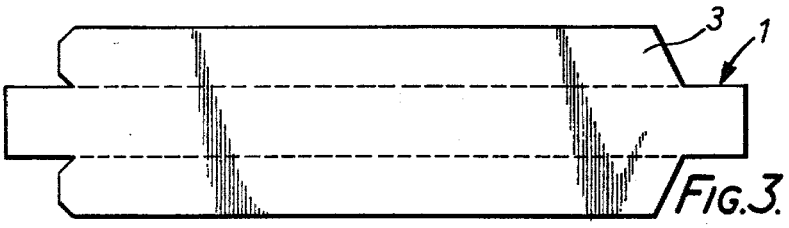
FIG. 3 is a top plan view of the package of FIG. 1.

The package shown in FIGS. 1 and 4 is conveniently formed from a single blank cut and folded to have an envelope section 1 of rectangular cross-section. The bottom wall 6 has a flap 7 turned up and secured to the inner surface of one side panel of the envelope, as best seen in FIGS. 2 and 4. The slots 2 are bounded from above by flaps 3 which are co-planar with the top wall of the envelope.

Figure 5:
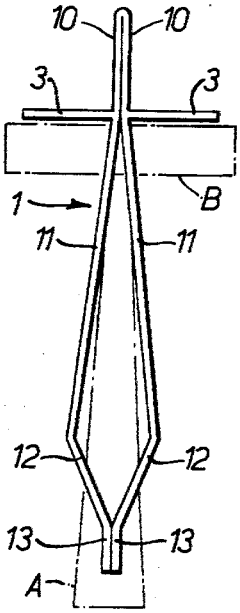
FIGS. 5 and 6 are an end view and scrap side view of a second form of package.
Figure 6:
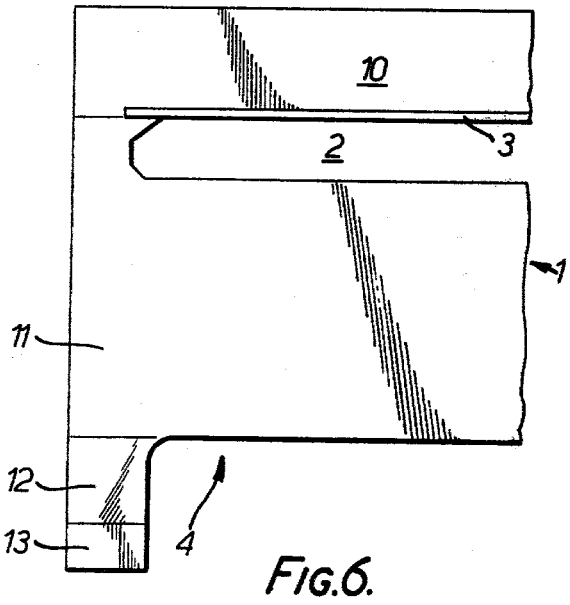

In the embodiment shown in FIGS. 5 and 6, the blank is symmetrically formed and folded about its top edge, having a pair of upper marginal panels 10 secured together face-to-face directly above the separate projecting flaps 3 which overlie the slots 2, divergent side panels 11, and convergent legs 12 secured face-to-face over their lower regions 13, with the opening 4 formed by large rectangular cut-outs between the legs 12.

Figure 7:
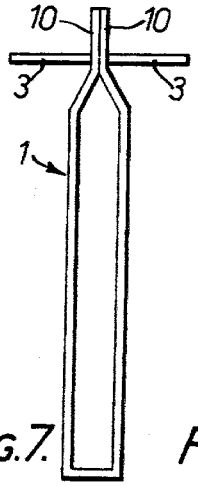
FIGS. 7 and 8 are an end view and scrap side view of a third form of package.
Figure 8:
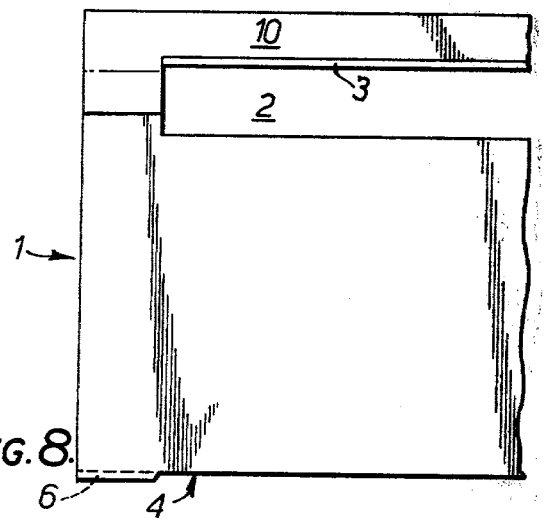

The embodiment of FIGS. 7 and 8 has its upper region shaped like that of FIGS. 5 and 6, but the upper marginal panels 10 in this case are conveniently formed by opposed edges of the blank and the axis of symmetry of the blank is found at the bottom wall 6, which is integral with both side panels of the envelope section.

Those skilled in the art will recognize that mating faces of the card can be secured in various ways, such as by adhesive or staples, and that the blank can be designed in various ways to produce the desired final form. For example, the package could be formed from two similar blanks in the case of the embodiments of FIG. 5 and FIG. 7.

In each case, the packages are well adapted to the razors which they accommodate. The lengths of the slots 2 and openings 4 are of course designed to suit the number of razors in question. Automation of the packaging process is facilitated by the design of the packages, which can be pre-cut and partially formed prior to location of a group of razors, the packages then being folded up about the razors and secured to complete the operation.

The razor heads are preferably protected individually with snap-fitting caps, conveniently made as thermoformed mouldings, but the overlying flaps 3 provide an added measure of protection for the razor heads and give some protection to the caps themselves.

The packages could be given an outer protective wrapping, such as a shrink wrapped film or a plastic bag, but are in any event preferably formed with additional holes 14 (FIG. 1) to permit their being hung on peg-rack display stands.

What is claimed is:

1. A package for a plurality of razors each having an elongate handle and a transversely extending shaving head at the upper end thereof, the package being formed from card which is cut, shaped and secured to form an envelope enclosing at least the major portion of the lengths of the razor handles, the opposite sides of the envelopes each being formed with an elongate slot, the two said slots being in registry with each other to permit the shaving heads of the razors to project from each side of the envelope, and a pair of flaps integral with the remainder of the package overlying the projecting heads to each side of the envelope.

2. A package according to claim 1, formed from a single piece of card.

3. A package according to claim 1, wherein each flap has a profile complementary to an adjacent one of the said slots and is attached to the remainder of the package at one edge bordering the adjacent slot.

4. A package according to claim 3, wherein the two flaps are co-planar with each other and with a top wall interconnecting the upper edges of the sides of the envelope.

5. A package according to claim 3, wherein the card comprises a pair of upper panels secured together face-to-face to form an upstanding wall portion directly above the flaps.

6. A package according to any of claims 1–5, wherein the walls of the envelope section are interconnected at the lower edges by bottom wall portions which are spaced apart to define an opening through which the lower portions of the razor handles project.

* * * * *